United States Patent [19]

Won

[11] Patent Number: 4,619,004

[45] Date of Patent: Oct. 28, 1986

[54] PANTS WITH AIR VENTILATION PANEL

[75] Inventor: In H. Won, Seoul, Rep. of Korea

[73] Assignee: Choon Woo Lee, Seoul, Rep. of Korea

[21] Appl. No.: 730,636

[22] Filed: May 6, 1985

[30] Foreign Application Priority Data

May 16, 1984 [KR] Rep. of Korea ..... 84-4505[U]
Oct. 17, 1984 [KR] Rep. of Korea ..... 84-10177[U]

[51] Int. Cl.[4] ..... A41D 1/06
[52] U.S. Cl. ..... 2/227; 2/238; 2/247; 2/78 B; 2/DIG. 1
[58] Field of Search ..... 2/DIG. 1, 227, 228, 2/238, 79, 115, 78 B, 247, 250

[56] References Cited

U.S. PATENT DOCUMENTS 1,255,820 2/1978 Oppenheim ..... 2/78 B
3,793,646 2/1974 Tempelhof ..... 2/227
4,035,844 7/1977 Atack et al. ..... 2/DIG. 1

FOREIGN PATENT DOCUMENTS 301647 12/1928 United Kingdom ..... 2/115

*Primary Examiner*—H. Hampton Hunter
*Attorney, Agent, or Firm*—Cushman, Darby & Cushman

[57] ABSTRACT

Pants include an air ventilation panel at the crotch area in which a panel is provided with a net yarn cloth sewn to its back surface. A plurality of perforated eyelets are riveted to the panel and a ventilating net woven fiber is sewn to the panel. A zipper or magic tape fastener is fixed behind the panel to join the upper portion of the panel and the net yarn cloth wherein the panel may be used as an inside pocket.

3 Claims, 5 Drawing Figures

PANTS WITH AIR VENTILATION PANEL

This invention relates to pants with an air ventilating panel, and in particular, to pants which have sewn in the inside a panel in the crotch region with a net yarn cloth pocket into which a piece of heat insulating cloth may be inserted for protection against cold weather.

Specifically, this invention is a marked improvement over conventional pants which in comparison to this invention are very unsanitary since they fit tightly around the body trapping bad odors and perspiration moisture within the pants.

Accordingly, it is an object of the invention to provide pants which eliminate the aforementioned unsanitary aspects of conventional pants by increasing the air circulation in the crotch area. Furthermore, the exchange of fresh air by means of the ventilating panel contributes to better hygiene and temperature control thereby adding to the greater comfort and refreshing feeling of the wearer.

This invention will be described by way of example with reference to the accompanying drawings, in which.

Figure 1:
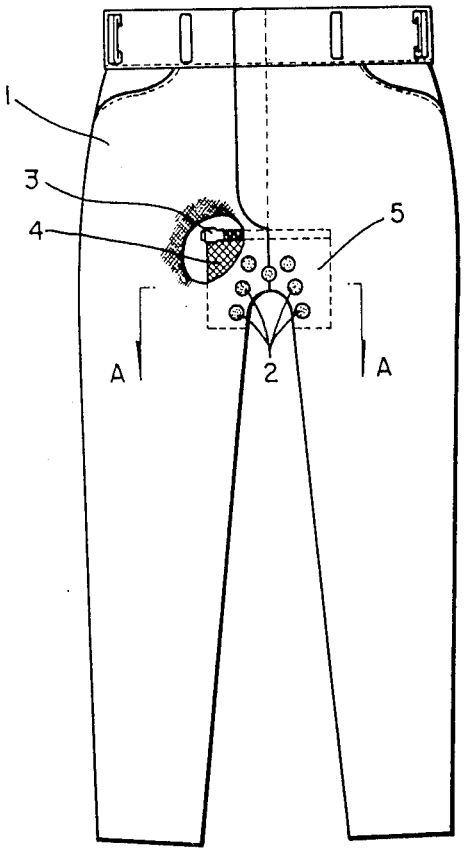
FIG. 1 shows a partially cut-away front view of the an embodiment of the invention.

As shown in FIG. 1, the crotch area of pants 1 consists of ventilating holes 2 arranged in appropriate positions in panel 5 into which perforated eyelets 2 are rivetted. Behind panel 5 is fixed a zipper 3 which opens and closes the net yarn cloth pocket 4 sewn on the inside of the panel.

Figure 2:
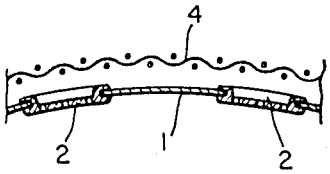
FIG. 2 illustrates in detail a cross-section view taken along the line A—A of FIG. 1.

As illustrated net yarn cloth 4 has an area substantially indentical to that of panel 5 and panel 5 and net yarn cloth 4 are arranged in a dual line as shown in FIG. 2.

As illustrated in FIG. 2 the eyelets 2 are riveted in the panel 5. Each eyelet 2 is formed of a plurality of perforated holes 6. As illustrated in FIG. 1 behind the panel 5 is fixed a zipper 3 which opens and closes a net yarn cloth 4 sewn on the inside of the panel.

Figure 3:
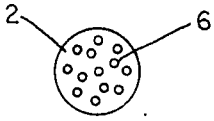
FIG. 3 shows rivets of FIG. 2 consisting of a plurality of perforated holes.

FIG. 3 shows a plurality of the perforated holes corresponding to the eyelets of FIG. 2.

Figure 4:
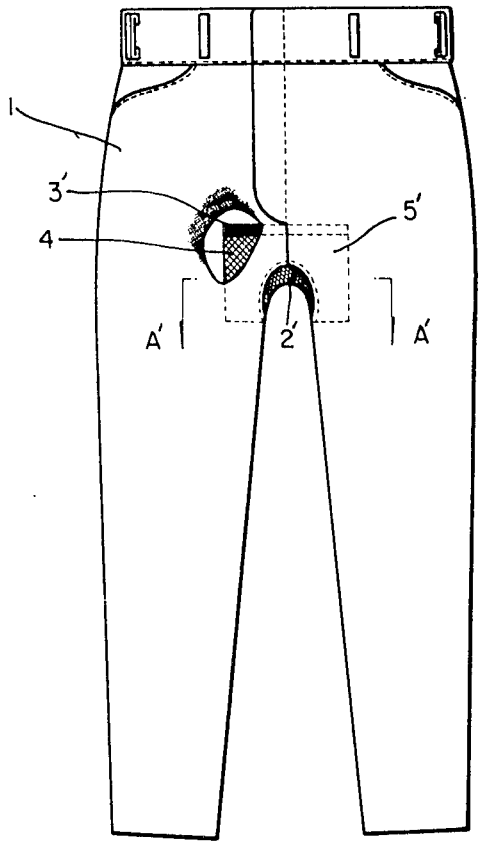
FIG. 4 shows a partially cut-away front view of another embodiment of this invention.

As shown in FIG. 4 of the second embodiment, in crotch area 5 of pants 1 is sewn an air ventilating net woven fabric panel 1 in appropriate size and location allowing ventilation of air. Behind 5' panel is fixed a magic tape or a VELCRO fastner 3' which opens and closes the inside net yarn cloth pocket.

Figure 5:
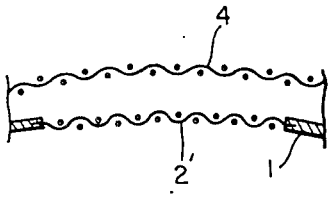
FIG. 5 illustrates in detail a cross-section and close-up view taken along the line A'—A' of FIG. 3.

In FIG. 5 it is noted that panel 5' is formed of a dual arrangement by providing an air ventilating net woven fiber 2 and net yarn cloth 4.

The effect of the above embodiments is to increase ventilation of fresh air within pants thereby decreasing perspiration moisture and unsanitary odors originating from the crotch area.

Furthermore, by means of zipper 3 or a VELCRO fastener 3', a piece of heat insulating cloth may be inserted into the inside pocket for protection against cold weather. The inside pocket may also be used as a secret compartment.

What is claimed:

1. Pants with an air ventilation panel comprising:
   - a plurality of perforated eyelets riveted to said panel and providing ventilation openings therein;
   - a net fabric sewn to the back surface of said panel along the edge thereof, a portion of said edge of said net fabric being left unsewn;
   - a zipper one stringer secured to said ventilation panel and the other stringer secured to said unsewn edge for opening and closing said net fabric whereby an openable and closable pocket is formed therebetween.

2. Pants with an air ventilation panel comprising:
   - an air ventilating net woven fabric sewn to a crotch area of said pants;
   - a net fabric sewn to the back surface of said panel along the edges thereof, a portion of the edge of said second net fabric being left unsewn; and
   - mating separable fastening means on the inside of said panel, a first part of said separable fastening means being secured to the back surface of said first net fabric and a second part of said mating separable fastening means being secured to the unsewn edge of said second net fabric whereby an openable and closable pocket is formed therebetween.

3. The pants of claim 4 wherein said mating separable fastening means for opening and closing said pocket comprises a hook-and-pile type separable fastener.

* * * * *